US008613571B1

(12) United States Patent
Watson, III et al.

(10) Patent No.: US 8,613,571 B1
(45) **Date of Patent: *Dec. 24, 2013**

(54) METHOD FOR PLACING REINFORCED CONCRETE PILING WITHOUT UTILIZING A PILE DRIVER OR AN AUGER

(75) Inventors: Thomas B. Watson, III, Pensacola, FL (US); Kenneth L. VanPolen, Camesville, GA (US)

(73) Assignee: Heli-Crete "Eco-Friendly" Piling Systems, LLC, Dahlonega, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/539,393

(22) Filed: Jun. 30, 2012

Related U.S. Application Data

(63) Continuation of application No. 12/802,228, filed on Jun. 2, 2010, now Pat. No. 8,240,957.

(51) Int. Cl.
*E02D 7/22* (2006.01)
*E02D 5/56* (2006.01)

(52) U.S. Cl.
USPC ..... 405/242; 405/252.1

(58) Field of Classification Search
USPC ..... 405/229, 231, 232, 233, 241, 242, 405/252.1; 175/19, 22
See application file for complete search history.

(56) References Cited

U.S. PATENT DOCUMENTS

| | | | | |
|---|---|---|---|---|
| 4,708,530 | A * | 11/1987 | Faber | 405/252 |
| 5,707,180 | A * | 1/1998 | Vickars et al. | 405/233 |
| 5,833,399 | A * | 11/1998 | Bullivant | 405/233 |
| 5,927,905 | A | 7/1999 | van Halteren | 405/252.1 |
| 6,652,195 | B2 * | 11/2003 | Vickars et al. | 405/239 |
| 6,814,525 | B1 * | 11/2004 | Whitsett | 405/233 |
| 6,820,379 | B1 * | 11/2004 | Krinner et al. | 52/157 |
| 6,824,331 | B2 | 11/2004 | Parker | 405/259.1 |
| 7,004,683 | B1 | 2/2006 | Rupiper | 405/229 |
| 2006/0127188 | A1 | 6/2006 | Francis | 405/231 |

* cited by examiner

*Primary Examiner* — Tara M. Pinnock
(74) *Attorney, Agent, or Firm* — Smith Risley; Steven P. Wigmore

(57) ABSTRACT

Disclosed are piling apparatus and methods for installing a reinforced concrete piling apparatus into the ground without the use of a pile driver or an auger. A helical screw anchor and coupling device are used to pull pipe sections into the ground. A preassembled reinforcing rod cage is placed into the pipe sections in the ground. Wet concrete is poured into the pipe sections to encase the reinforcing rod cage. The pipe sections are then removed. Removal of the pipe sections from the helical screw anchor is accomplished using the coupling device.

19 Claims, 6 Drawing Sheets

METHOD FOR PLACING REINFORCED CONCRETE PILING WITHOUT UTILIZING A PILE DRIVER OR AN AUGER

PRIORITY AND RELATED APPLICATIONS STATEMENT

This application claims priority under 35 U.S.C. §120 and is a continuation of U.S. patent application Ser. No. 12/802,228 filed on Jun. 2, 2010 now U.S. Pat. No. 8,240,957 and entitled, "REMOVABLE COUPLER APPARATUS AND METHOD FOR USE IN PLACING PILINGS IN THE GROUND," the entire contents of which are hereby incorporated by reference.

BACKGROUND

The present invention relates generally to piling apparatus and methods for placing or installing reinforced concrete piles into the ground without utilizing a pile driver or an auger.

Pilings are often used to support buildings, bridges, antenna structures, or other structures, for example. Conventionally, reinforced concrete piles are placed in the ground by one of two methods. The first method places a precast reinforced concrete pile into the ground by using a pile driver and hammering the pile into the ground. The second method places a reinforced concrete pile into the ground by drilling a circular hole using an auger, removing the soil, placing a pre assembled circular, for example, steel reinforcing rod cage into the hole and pouring wet concrete into the hole to encase the steel reinforcing rod cage.

More particularly, conventional helical pilings typically include one or more helical screw(s) or helices. The shaft is rotated to force the helical screw downwardly into the earth. The piling is screwed downwardly until the screw is seated in a region of soil sufficiently strong to support the load from the structure that it is to support. An additional piling is attached or spliced to a previously screwed piling to increase the depth of the overall piling. To accomplish this, adjacent round or circular ends of the pilings are reconfigured to have a generally square shape with rounded corners. The adjacent ends are configured to have male and female cross-sections so that the piles slide together forming a telescoping joint and are spliced to make a continuous piling.

U.S. Pat. No. 6,814,525 issued to Whitsett discloses conventional piling apparatus and installation methods. The Whitsett patent discloses in its Abstract, for example, that an "in-situ pile apparatus includes a helical anchor to which a plurality of elongated generally cylindrically shaped sections can be added. Each of the sections has a specially shaped end portion for connecting to another section. An internal drive is positioned in sections inside the bore of each of the connectable pile sections. The internal drive includes enlarged sections that fit at the joint between pile sections. In one embodiment, the internal drive can be removed to leave a rod behind that defines reinforcement for an added material such as concrete. The rod also allows for a tension rod connection from the anchor tip to an upper portion attachment point."

Conventional composite helical pipe piling apparatus is distributed by MacLean Dixie HFS. This piling apparatus could include reinforcing rods and a concrete core within the steel pipe piles hollow inside, however, the steel pipe piling would remain in the ground.

It would be desirable to have a reinforced concrete piling apparatus that may be installed in the ground without requiring a pile driver or an auger.

BRIEF DESCRIPTION OF THE DRAWINGS

The various features, functionalities and practical advantages of the present invention may be more readily understood with reference to the following detailed description taken in conjunction with the accompanying drawings, wherein like reference numerals designate like structural elements, and in which.

DETAILED DESCRIPTION

Disclosed are piling apparatus and methods for installing piling apparatus into the ground without the use of a pile driver or an auger. In accordance with the teachings disclosed herein, a helical screw anchor and coupling device are used to pull pipe sections down into the ground. A preassembled circular, for example, steel reinforcing rod cage is placed into the pipe sections in the ground. Wet concrete is poured into the pipe sections in the ground to encase the steel reinforcing rod cage. The pipe sections are then removed. Removal of the pipe sections from the helical screw anchor is accomplished using the coupling device.

Figure 1:
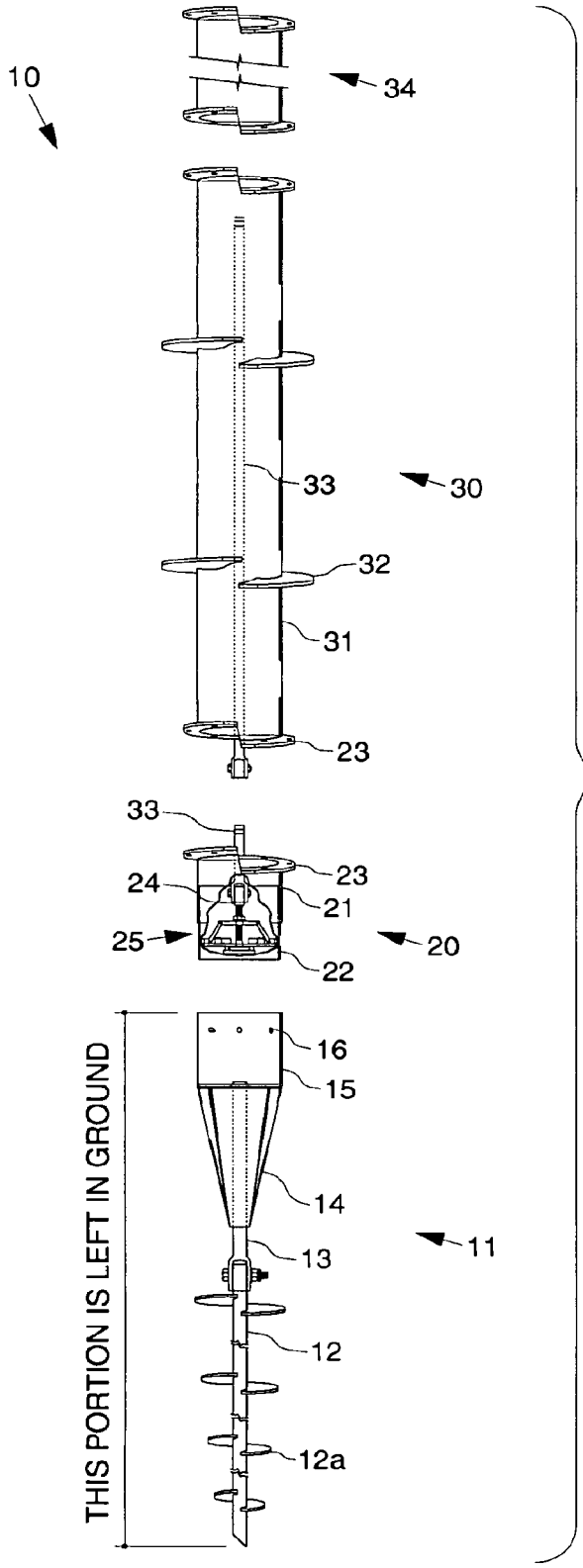
FIG. 1 is an elevational view of exemplary piling apparatus.
Figure 2:
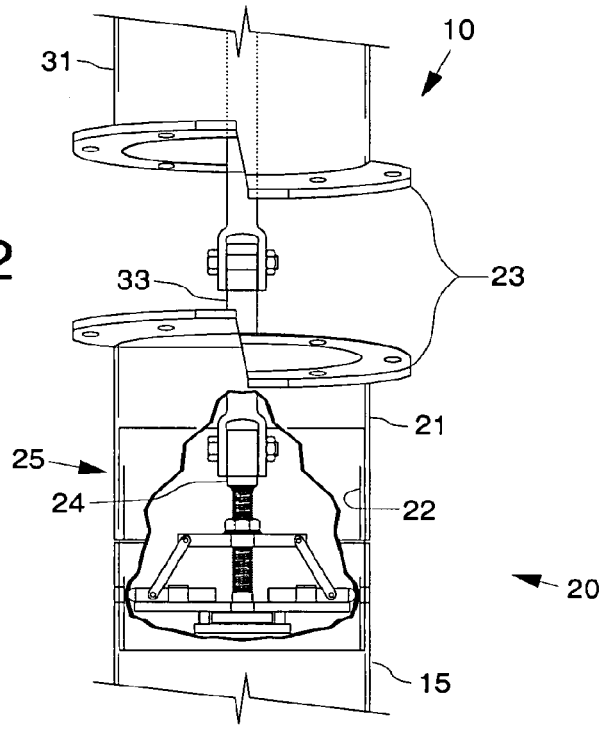
FIG. 2 is an enlarged view of a coupler assembly used in the apparatus shown in FIG. 1.
Figure 3:
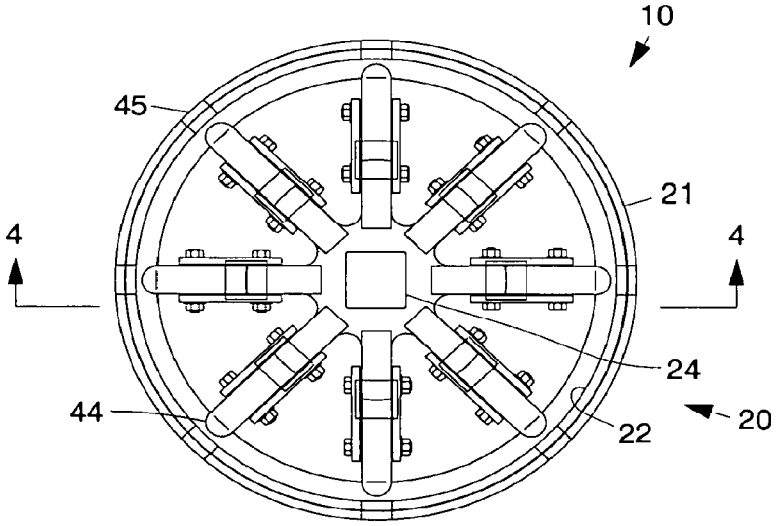
FIG. 3 is a plan view of the coupler assembly shown in FIG. 2 with shear pins not engaged.
Figure 4:
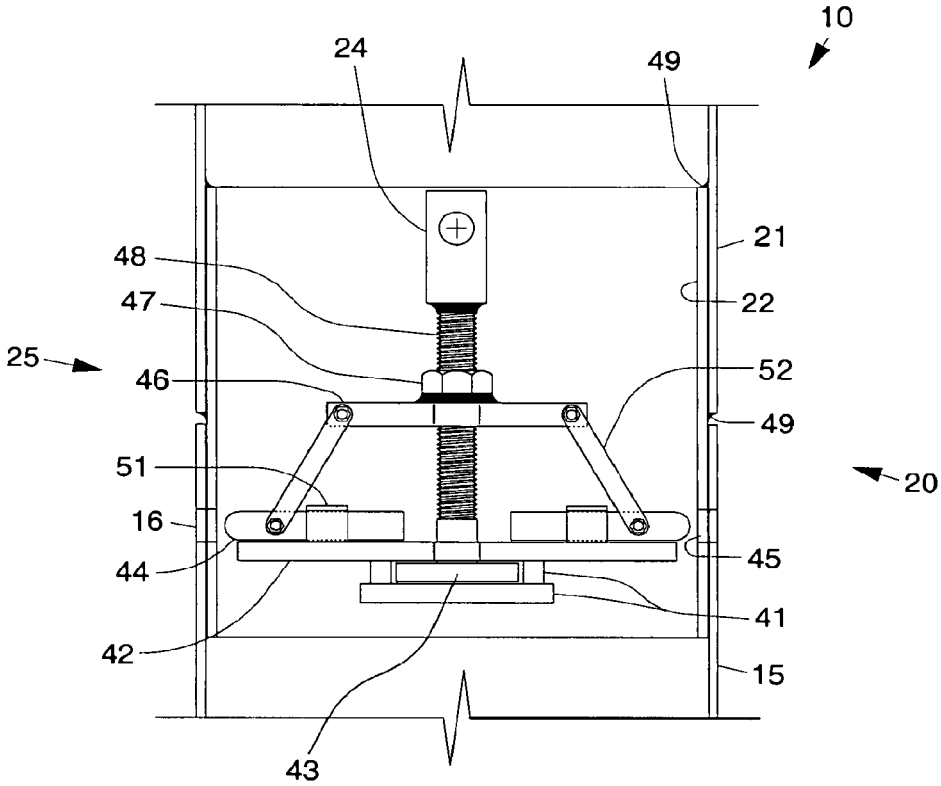
FIG. 4 is a sectional view of the coupler assembly shown in FIG. 2 taken along the lines 4-4.
Figure 5:
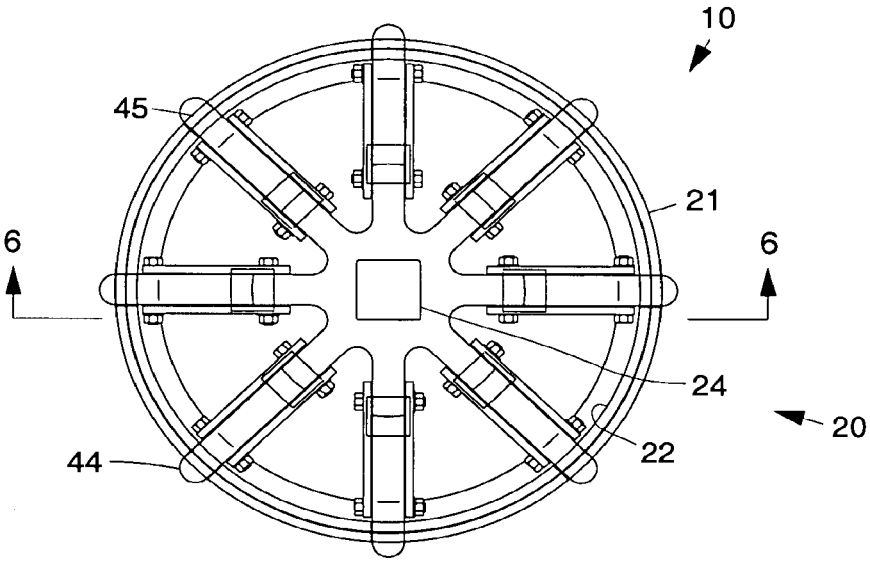
FIG. 5 is a plan view of the coupler assembly shown in FIG. 2 with shear pins engaged.
Figure 6:
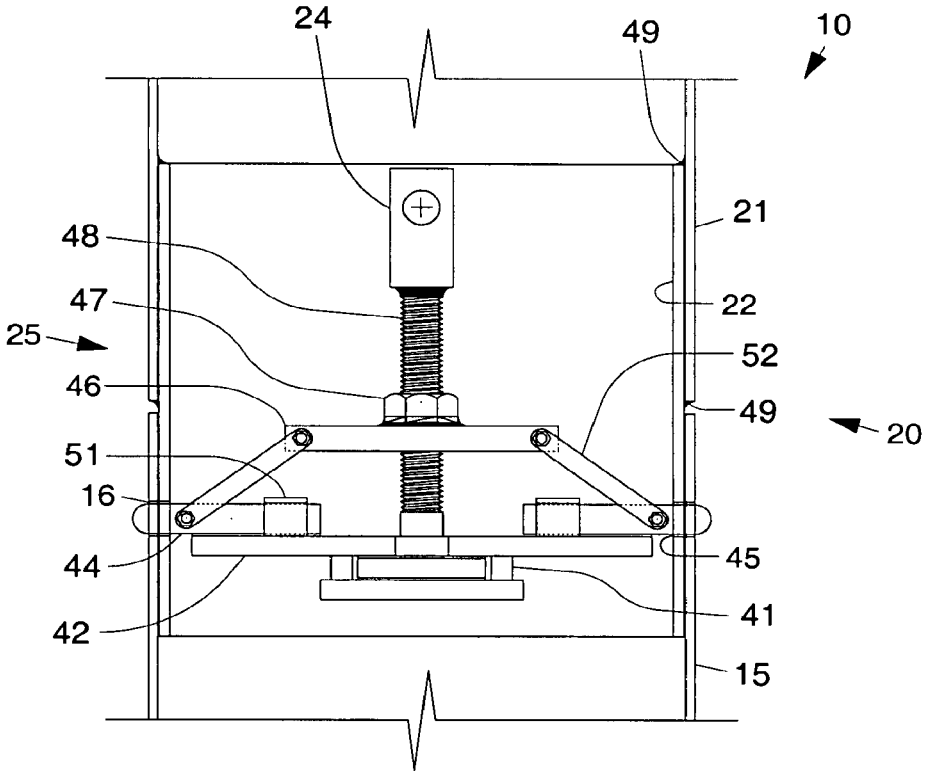
FIG. 6 is a sectional view of the coupler assembly shown in FIG. 5 taken along the lines 5-5.

Referring to the drawing figures, FIGS. 1-6 illustrate various views of exemplary piling apparatus 10. More particularly, FIG. 1 is an elevational view of exemplary piling apparatus 10. FIG. 2 is an enlarged view of a coupler section 20 of the apparatus 10. FIG. 3 is a plan view of the coupler section 20 shown in FIG. 2 with shear pins 44 not engaged. FIG. 4 is a sectional view of the coupler section 20 shown in FIG. 2 taken along the lines 4-4. FIG. 5 is a plan view of the coupler section 20 shown in FIG. 2 with shear pins 44 engaged. FIG. 6 is a sectional view of the coupler section 20 shown in FIG. 5 taken along the lines 5-5.

As shown in FIG. 1, the exemplary piling apparatus 10 comprises an anchor assembly 11 that includes a helical screw anchor 12 having a plurality of helices (12*a*), an extension shaft 13, a tapered reducer section 14, and a lower pipe section 15 having a plurality of shear pin holes 16 disposed around its periphery. During use, the anchor assembly 11 is screwed into the ground to a depth such that the shear pin holes 16 are several inches above ground level.

The piling apparatus 10 also comprises a coupler section 20, shown in detail in FIGS. 2-6, that includes a coupler pipe section 21 with an inner splice ring 22 attached to the coupler pipe section 21, and a helical flange 23 attached at its upper end of the coupler pipe section 21. A coupler 25 is disposed within the coupler pipe section 21. A short square shaft bar 24 extends from an upper end of the coupler 25 above the helical flange 23. The short square shaft bar 24 is coupled to the coupler 25 as will be described below. Details of the coupler section 20 are provided with reference to FIGS. 3-6.

The coupler pipe section 21 is coupled to a pipe section 30 with the standard width helices 32. The short square shaft bar 24 is coupled to a section of square shaft bar 33 that extends through the pipe section 30. Additional pipe sections 30 are coupled to the previous pipe section 30 as required. A final pipe section 34 without the intermediate helices is disposed at the upper end of the apparatus 10.

As is shown in FIGS. 3 and 4, the coupler pipe section 21 is welded 49 to the splice ring 22. The coupler 25 comprises a plurality of thrust plate guide plates 41 that are attached to a lower coupler plate 42. A thrust plate 43 is disposed within the plurality of thrust plate guide plates 41. A plurality of transversely slidable shear pins 44 are slidably attached to the lower coupler plate 42. The shear pins 44 are aligned with a corresponding plurality of shear pin holes 45 in the inner splice ring 22. In addition, the shear pin holes 45 in the inner splice ring 22 align with the shear pin holes 16 in the lower pipe section 15. Note that any number of shear pins 44 and corresponding shear pin holes 45, 16 may be employed. The actual number of shear pins 44 and shear pin holes 45, 16 may vary depending on the overall design.

The short square shaft bar 24 is attached to a threaded rod 48 that extends through a nut 47 welded to an upper coupler plate 46. The threaded rod 48 extends through the lower coupler plate 42 and is attached to the thrust plate 43. A plurality of shear pin slide guides 51 are attached to the lower coupler plate 42 through which the shear pins 44 slide. The shear pins 44 are attached to the upper coupler plate 46 by way of a plurality of shear pin position arms 52.

The coupler pipe section 20 with the coupler 25 and splice ring 22 are placed into the lower pipe section 15 and oriented such that the shear pins 44 in the coupler 25 are aligned with the shear pin holes 45 in the inner splice ring 22 and shear pin holes 16 in the lower pipe section 15. Horizontal movement of the shear pins 44 is controlled by rotating the threaded rod 48, which causes the upper coupler plate to lower toward the lower coupler plate and force the shear pins 44 outward, and vice versa. This is illustrated in FIGS. 3, 4, 5 and 6.

Figure 11:
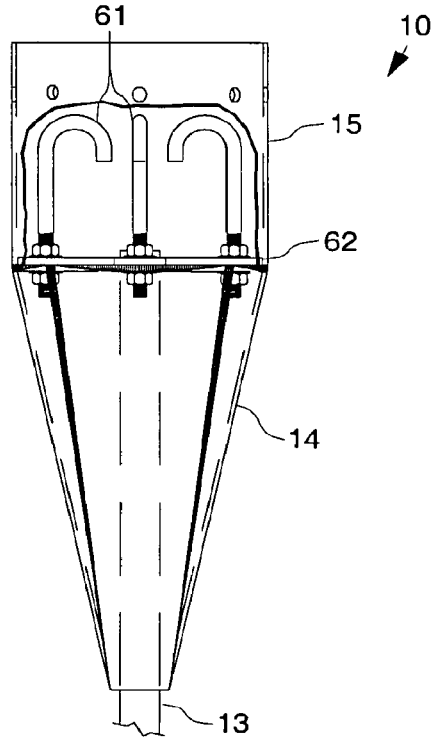
FIG. 11 is an enlarged view of a portion of FIG. 10 showing the j-shaped bolts in more detail.
Figure 7:
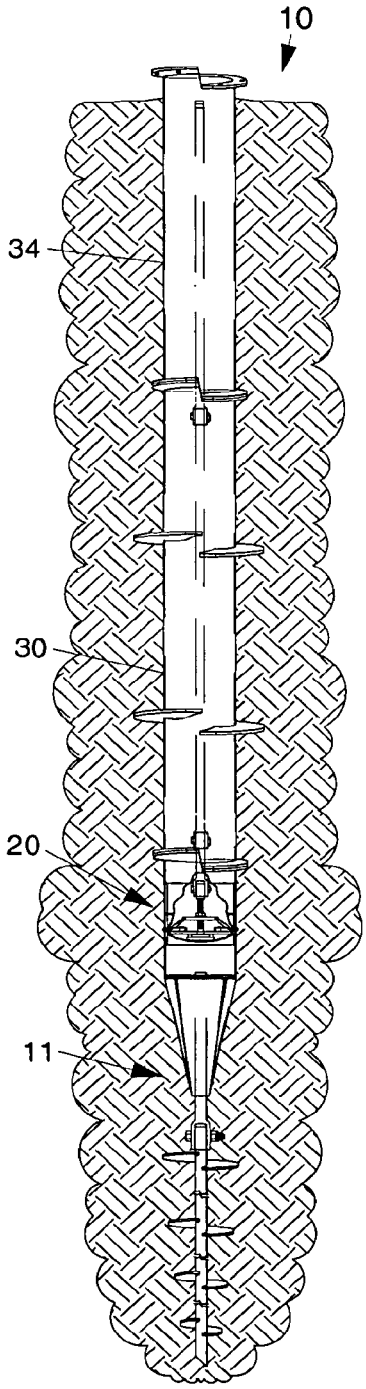
FIGS. 7-9 illustrate installation of exemplary piling apparatus.
Figure 8:
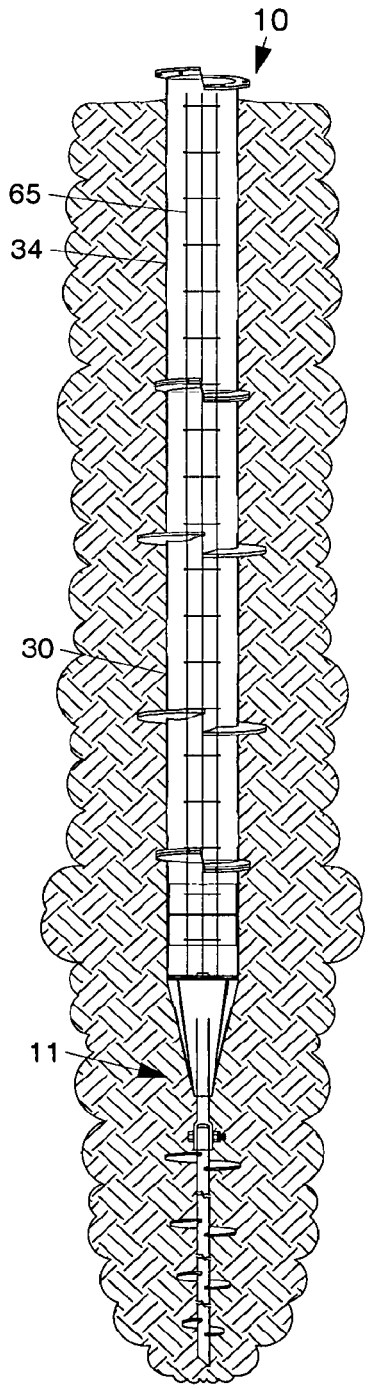
Figure 9:
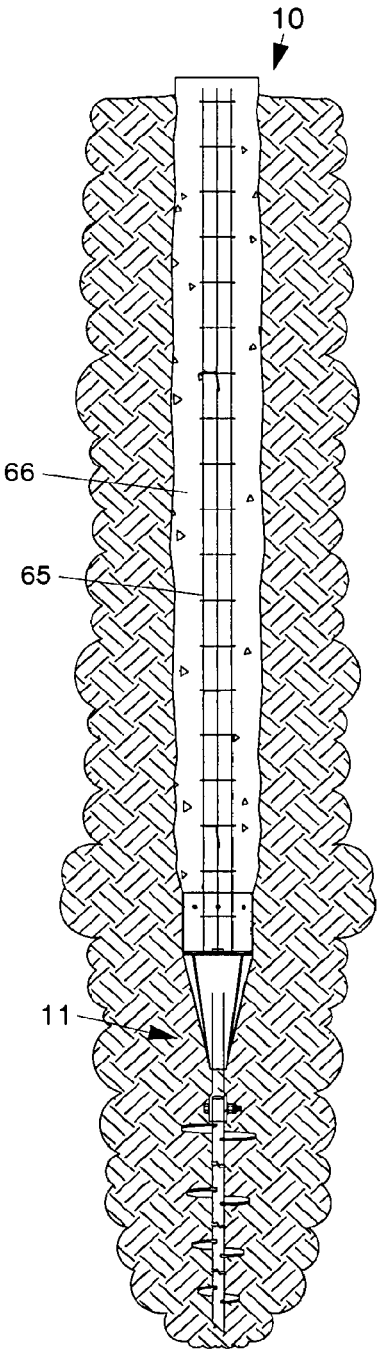
Figure 10:
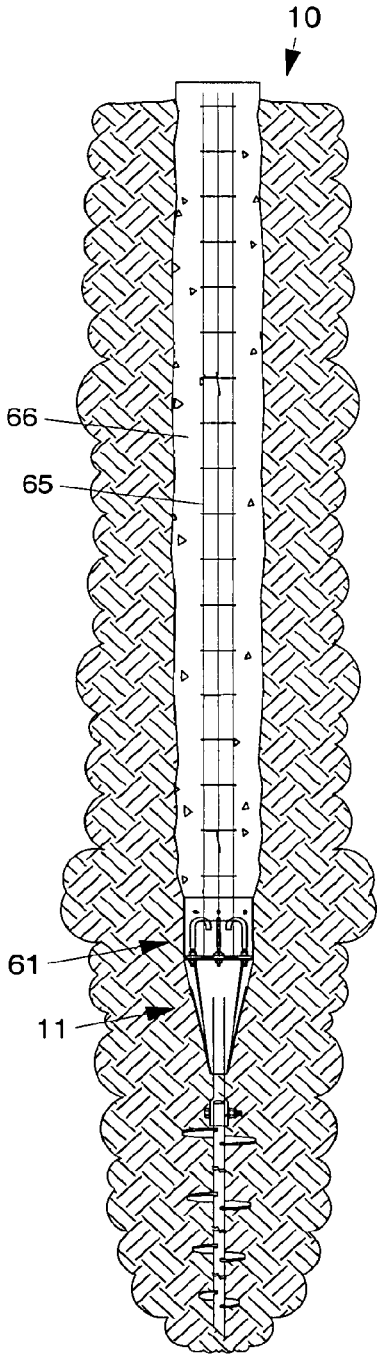
FIG. 10 illustrates an installed piling comprising j-shaped bolts.

FIGS. 7-9 illustrate installation of exemplary piling apparatus 10. FIG. 10 illustrates installed piling apparatus 10 comprising j-shaped bolts 61. FIG. 11 is an enlarged view of a portion of FIG. 10 showing the j-shaped bolts 61 in more detail. The j-shaped bolts 61 are attached by way of nuts to an extension shaft plate 62 disposed in the reducer section 14.

Details regarding an exemplary procedure or method for installing the reinforced concrete piling apparatus 10 without utilizing a pile driver or an auger is as follows. An assembly comprising the helical screw anchor 12, extension shaft 13, reducer section 14 and lower pipe section 15 having a plurality of shear pin holes 16 disposed around its periphery are screwed into the ground to a depth such that the shear pin holes 16 are several inches above ground level. Next the coupler pipe section 20 with the coupler 25 and the splice ring 22 are placed into the lower pipe section 15 and oriented such that the shear pins 44 in the coupler 25 are aligned with the shear pin holes 16 in the lower pipe section 15.

The short square shaft bar 24, which is welded to the threaded rod 48, is bolted to a short square shaft female end 33. The short square shaft bar 24 is then rotated counterclockwise. The counterclockwise rotation of the threaded rod 48 forces the upper coupler plate 46 and welded nut 47 downward which in turn causes the shear pin positioning arms 52 to push the shear pins 44 through the shear pin holes 45, 16. Once the shear pins 44 protrude through the shear pin holes 45, 16, torque may be transmitted through the coupler pipe section 20.

A long section of square shaft bar 33 is then bolted to the short section of square shaft bar 33 and a pipe section 30 with the standard width helices 32 is bolted to the coupling pipe section 20 containing the coupling device 25. All of the pipe sections 20, 30 have helical flanges 23. This serves two purposes. The first is for splicing of the two pipe sections 20, 30. The second is when the pipe sections 20, 30 are required to be removed, counterclockwise torque can be applied to the helical flanges 23 and the pipe sections will "unscrew" themselves out of the ground.

The torque required for installation and removal is always applied to the pipe sections 20, 30. Because the helical flanges 23 are typically narrow, approximately 2 inches in width, standard width helices 32 may be required for the removal of the pipe sections 20, 30. The bottom one or two pipe sections 30 may require standard width helices to assist with the surface area needed to back out all of the pipe sections 20, 30 being removed.

Once all of the square shaft bars 13, 24, 33 and all of the pipe sections 15, 20, 30 have been screwed into the ground to a desired depth (see FIG. 7) the square shaft bar 33, 24 is rotated clockwise. The clockwise rotation of the threaded rod 48 in the coupling device 25 forces the upper coupler plate 46 and welded nut 47 upward which in turn causes the shear pin positioning arms 52 to pull the shear pins 44 out of the shear pin holes 45, 16, thus releasing all of the pipe sections 30 from the lower pipe section 15, which is left permanently in the ground. The square shaft bars 33, 24 and the coupling device 25 are then pulled up through the pipe sections 30 and set aside.

Steel reinforcing rods 65 are then placed into the pipe sections 30 (see FIG. 8). Concrete 66 is then poured into the pipe sections 30 in volumes approximating the length of one or more pipe sections 30. The pipe sections 30 are removed by "unscrewing" them one-by-one, making certain that the top surface of the wet concrete is always above the bottom helical flange 23 of the bottommost pipe section 30. This may be done by intermittently adding more concrete until all of the pipe sections 30 have been removed so that the hole previously occupied by the pipe sections is completely filled with wet concrete (see FIG. 9).

The resulting concrete piling has a capacity in compression that is based on the friction between the soil and the concrete 66 along the length of the concrete piling plus the bearing capacity of the soil below the helical screw anchor 12. The concrete piling tension capacity, however, is limited to the friction between the soil and the concrete 66 along the length of the concrete piling. Without an apparatus to provide a tension connection between the helical screw anchor 12 and the concrete piling, there would be no method for transferring the bearing capacity of the soil above the helical screw anchor 12.

An exemplary way to transfer tension from the helical screw anchor 12 to the concrete piling is accomplished by attaching j-shaped bolts to the top side of the welded extension shaft plate. FIG. 10 illustrates a piling comprising j-shaped bolts, and FIG. 11 is an enlarged view of a portion of FIG. 10 showing the j-shaped bolts in more detail. The j-shaped bolts transfer the tension from the concrete piling into a welded extension shaft plate 62 and through the extension shaft 13 into helices 12*a* of the helical screw anchor 12.

Thus, apparatus and methods for placing reinforced concrete piles into the ground without utilizing a pile driver or an auger have been disclosed. It is to be understood that the above-described embodiments are merely illustrative of some of the many specific embodiments that represent applications of the principles discussed above. Clearly, numerous other arrangements can be readily devised by those skilled in the art without departing from the scope of the invention.

What is claimed is:

1. A method of preparing ground to place piles therein, said method comprising:

rotating an anchor assembly comprising a screw anchor, an extension shaft coupled to the screw anchor, a reducer section having a plurality of pin holes disposed around its periphery into the ground to a predetermined depth;

positioning in the anchor assembly a removable coupler apparatus comprising a rotatable longitudinal shaft that is coupled to a plurality of slidable pins that are slidable through the pin holes in the anchor assembly and orienting it so that the pins are aligned with the pin holes;

rotating the longitudinal shaft to slide the pins through the pin holes and secure the removable coupler apparatus to the anchor assembly;

attaching a shaft section to the longitudinal shaft and attaching a pipe section to the removable coupler apparatus; and rotating the pipe section to cause the anchor assembly and removable coupler apparatus to be pulled into the ground to a desired depth.

2. The method of claim 1, further comprising rotating the longitudinal shaft to slide the pins out of the pin holes to release the removable coupler apparatus and pipe section from the screw anchor, which is left in the ground.

3. The method of claim 1, wherein the screw anchor comprises a helical shape.

4. The method of claim 1, further comprising placing reinforcing rods in the pipe section before the pipe section is removed from the ground.

5. The method of claim 4, further comprising pouring concrete into the pipe section after the reinforcing rods are placed in the pipe section and before the pipe section is removed from the ground.

6. The method of claim 1, further comprising coupling the extension shaft to a plate disposed within the reducer section.

7. The method of claim 6, further comprising coupling one or more J-shaped bolts to the plate.

8. The method of claim 7, further comprising placing reinforcing rods in the pipe section before the pipe section is removed from the ground.

9. The method of claim 8, further comprising pouring concrete into the pipe section after the reinforcing rods are placed in the pipe section and before the pipe section is removed from the ground.

10. A system for preparing ground to place piles therein, said system comprising:

an anchor assembly comprising a screw anchor, an extension shaft coupled to the screw anchor, a reducer section having a plurality of pin holes disposed around its periphery;

a removable coupler apparatus positioned within the anchor assembly comprising a rotatable longitudinal shaft that is coupled to a plurality of slidable pins that are slidable through the pin holes in the anchor assembly, the coupler apparatus being oriented so that the pins are aligned with the pin holes; the pins being slidingly engaged and penetrating through the pin holes to secure the removable coupler apparatus to the anchor assembly;

a shaft section attached to the longitudinal shaft; and pipe section attached to the removable coupler apparatus.

11. The system of claim 10, wherein rotation of the longitudinal shaft causes the pins to slide out of the pin holes to release the removable coupler apparatus and pipe section from the screw anchor.

12. The system of claim 10, wherein the screw anchor comprises a helical shape.

13. The system of claim 10, wherein each pin is coupled to a position arm.

14. The system of claim 13, wherein each position arm is coupled to a plate.

15. The system of claim 14, further comprising a rotatable longitudinal shaft with screw threads that slidably engages each plate.

16. The system of claim 15, wherein the plate comprises a first plate, the system further comprising the extension shaft coupled to a second plate disposed within the reducer section.

17. The system of claim 16, further comprising one or more J-shaped bolts coupled to the second plate.

18. The system of claim 17, further comprising a plurality of position arms extending from the first plate in a radial fashion around the longitudinal shaft.

19. The system of claim 10, further comprising reinforcing rods placed in the pipe section.

* * * * *